US012152599B2

(12) United States Patent
Asadullah et al.

(10) Patent No.: US 12,152,599 B2
(45) Date of Patent: Nov. 26, 2024

(54) COMPOSITE METAL CENTRIFUGAL SLURRY PUMP IMPELLER

(71) Applicant: Weir Slurry Group, Inc., Madison, WI (US)

(72) Inventors: Mohammed Asadullah, Verona, WI (US); Matthew Barton, Calgary (CA)

(73) Assignee: Weir Slurry Group, Inc., Madison, WI (US)

( * ) Notice: Subject to any disclaimer, the term of this patent is extended or adjusted under 35 U.S.C. 154(b) by 100 days.

(21) Appl. No.: 18/015,699

(22) PCT Filed: Aug. 18, 2021

(86) PCT No.: PCT/AU2021/050909

§ 371 (c)(1),
(2) Date: Jan. 11, 2023

(87) PCT Pub. No.: WO2022/036398

PCT Pub. Date: Feb. 24, 2022

(65) Prior Publication Data

US 2023/0332613 A1 Oct. 19, 2023

Related U.S. Application Data

(60) Provisional application No. 63/066,999, filed on Aug. 18, 2020.

(30) Foreign Application Priority Data

Oct. 23, 2020 (AU) ..... 2020903842

(51) Int. Cl.

| | |
|---|---|
| ***F04D 29/22*** | (2006.01) |
| ***F04D 7/04*** | (2006.01) |
| ***F04D 29/02*** | (2006.01) |

(52) U.S. Cl.

CPC ..... *F04D 29/2294* (2013.01); *F04D 7/04* (2013.01); *F04D 29/026* (2013.01); *F04D 29/2227* (2013.01)

(58) Field of Classification Search

CPC . F04D 29/2294; F04D 29/2227; F04D 29/289
See application file for complete search history.

(56) References Cited

U.S. PATENT DOCUMENTS 7,429,160 B2 * 9/2008 Roudnev ..... F04D 29/167 415/174.3
8,403,639 B2 3/2013 Vedsted et al.
(Continued)

FOREIGN PATENT DOCUMENTS

| | | |
|---|---|---|
| CN | 110792605 A | 2/2020 |
| WO | 2008038306 A2 | 4/2008 |
| WO | 2019119043 A1 | 6/2019 |

*Primary Examiner* — Sabbir Hasan
(74) *Attorney, Agent, or Firm* — Morriss O'Bryant; Compagni Cannon, PLLC.

(57) ABSTRACT

A composite metal centrifugal slurry pump impeller including aback shroud with opposed inner and outer faces with an outer peripheral edge and a central axis, a plurality of pumping vanes extending away from the inner main face of the back shroud, the pumping vanes being disposed in spaced apart relation, each pumping vane including opposed main side faces, a leading edge in the region of the central axis and a trailing edge in the region of the outer peripheral edge of the back shroud with a passageway between adjacent pumping vanes, wherein one or more cavities are located in the back shroud in the region of at least one of the passageways and wherein a wear resistant composition is bonded at least partially within the one or more cavities.

23 Claims, 13 Drawing Sheets

(56) References Cited

U.S. PATENT DOCUMENTS

| | | | | |
|---|---|---|---|---|
| 2010/0272563 | A1 | 10/2010 | Chiovelli | |
| 2016/0312789 | A1 | 10/2016 | Moon | |
| 2020/0332806 | A1* | 10/2020 | Marshall | F04D 29/428 |

* cited by examiner

COMPOSITE METAL CENTRIFUGAL SLURRY PUMP IMPELLER

TECHNICAL FIELD

This disclosure relates in general to a composite metal slurry pump impeller.

BACKGROUND OF THE DISCLOSURE

Various process steps in the minerals processing industry involve erosive contact with components of equipment which results in significant wear to the extent that frequent replacement is required. However, often the wear of a component is uneven depending on the nature of the process step.

For example, in the process of pumping abrasive slurries using a centrifugal slurry pump, a limiting factor on the centrifugal slurry pump wet end component wear life can be localised wear in the form of deep gouging or very high wear rates in certain locations of the slurry pump impeller even though other parts of the impeller may be wearing at a relatively low rate.

The present invention seeks to provide a relatively low cost composite metal slurry pump impeller that provides an impeller that includes localised wear protection for use in the minerals processing industry.

SUMMARY

According to one aspect there is provided a centrifugal slurry pump impeller including a back shroud with opposed inner and outer faces with an outer peripheral edge and a central axis, a plurality of pumping vanes extending away from the inner main face of the back shroud, the pumping vanes being disposed in spaced apart relation, each pumping vane including opposed main side faces, a leading edge in the region of the central axis and a trailing edge in the region of the outer peripheral edge of the back shroud with a passageway between adjacent pumping vanes, wherein one or more cavities are located in the back shroud in the region of at least one of the passageways and wherein a wear resistant composition is bonded at least partially within the one or more cavities.

In certain embodiments, the one or more cavities is formed in the outer face of the back shroud whereby the wear resistant composition is not exposed to the passageway between adjacent pumping vanes. In one form, the one or more cavities include side walls and an end wall wherein the end wall is spaced from the surface of the inner main face of the back shroud. In a further form, the end wall is located within about 5 mm to about 25 mm from the surface of the inner main face of the back shroud.

In certain embodiments, the one or more cavities includes a circular opening, cylindrical shaped side walls and a circular shaped end wall.

In certain embodiments, a width of the end wall of the one or more cavities spans at least 50% of the width of the passageway between adjacent pumping vanes. In one form, a width of the end wall of the one or more cavities spans at least 75% of the width of the passageway between adjacent pumping vanes. On one form, a width of the end wall of the one or more cavities spans a distance that substantially covers the width of the passageway between adjacent pumping vanes.

In certain embodiments, the wear resistant composition substantially fills the one or more cavities. In one form, the wear resistant composition is cylindrical in shape. In one form, the wear resistant composition has a diameter which is greater that its height. In one form, the wear resistant composition is disk shaped and corresponds to the shape of the one or more cavities.

In certain embodiments, a plug portion is also located in the one or more cavities wherein the plug portion covers the wear resistant composition located within the one or more cavities. In one form, the plug portion includes an outer surface which is substantially flush, or in the same plane as a surface of the outer face of the back shroud.

In certain embodiments, the one or more cavities include side walls and an end wall wherein the side walls include a contact portion remote from the outer face of the back shroud wherein the contact portion is spaced from the surface of the inner main face of the back shroud. In one form, the one or more cavities include cylindrical side walls and a circular shaped end wall.

In certain embodiments, the contact portion of the side wall is located within about 5 mm to about 25 mm from the surface of the inner main face of the back shroud. In one form, the contact portion spans at least 50% of the width of the passageway between adjacent pumping vanes. In a further form, the contact portion spans at least 75% of the width of the passageway between adjacent pumping vanes.

In certain embodiments, the length of the side walls and the contact portion are orientated perpendicular to the direction of the flow passing through the passageways in use.

In certain embodiments, the length of the side walls and the contact portion are located in a plane that is perpendicular to the axis of rotation of the pump impeller in use.

In certain embodiments, the length of the side walls and the contact portion extend substantially across the passageway from one pumping vane to the other pumping vane.

In certain embodiments, the wear resistant composition has a diameter which is less that its height.

In certain embodiments, each passageway includes at least two cavities located between one pumping and the other pumping vane.

In certain embodiments, each passageway includes three cavities located in spaced relation along the length of the each passageway. In one form, the three cavities are located in the first two thirds of the length of each passageway.

In certain embodiments, the one or more cavities is formed in the inner face of the back shroud whereby the wear resistant composition is exposed to the passageway between adjacent pumping vanes.

In one form, the one or more cavities include side walls and an end wall wherein the end wall is spaced from the surface of the outer main face of the back shroud. In a further form, the end wall is located within about 5 mm to about 25 mm from the surface of the outer main face of the back shroud. In one form, the one or more cavities includes a circular opening, cylindrical shaped side walls and a circular shaped end wall.

In certain embodiments, the one or more cavities are inclined from the plane of the back shroud wherein the wear resistant composition bonded within the cavities is angled against the direction of the flow of slurry when the slurry pump impeller is in use.

In certain embodiments each passageway includes two or more cavities formed in the inner face of the back shroud. In one form, each passageway includes an inner region which begins adjacent the leading edge of the plurality of pumping vanes and ends mid-way along each passageway, which begins mid-way along each passageway and ends at an outer region adjacent the outer peripheral edge, wherein the one or more cavities are substantially located in the inner region of each passageway.

In certain embodiments, the wear resistant composition sits proud of the surface of the inner face of the back shroud. In one form, the wear resistant composition is cylindrical, cuboid or button shaped. In one form, the shape of the wear resistant composition has a height which is greater that its diameter.

In certain embodiments, the wear resistant composition is bonded into the one or more cavities using an adhesive or by a brazing method.

In certain embodiments, the slurry pump impeller is composed of a high chromium white cast iron.

In certain embodiments, the wear resistant composition is selected from tungsten carbide.

In certain embodiments, the pump impeller includes a front shroud having an inner main face wherein the plurality of pumping vanes extend between the inner main faces of the back and front shrouds.

In certain embodiments, the wear resistant composition is gradually exposed as the pumping vanes are subjected to wear during operation of the centrifugal slurry pump.

In certain embodiments, the one or more cavities include a circular opening and frustoconical side walls. In one form, the wear resistant composition is frustoconical in shape.

In certain embodiments, the one or more cavities pass from the outer face of the back shroud to the inner face of the back shroud in the region of the passageways.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
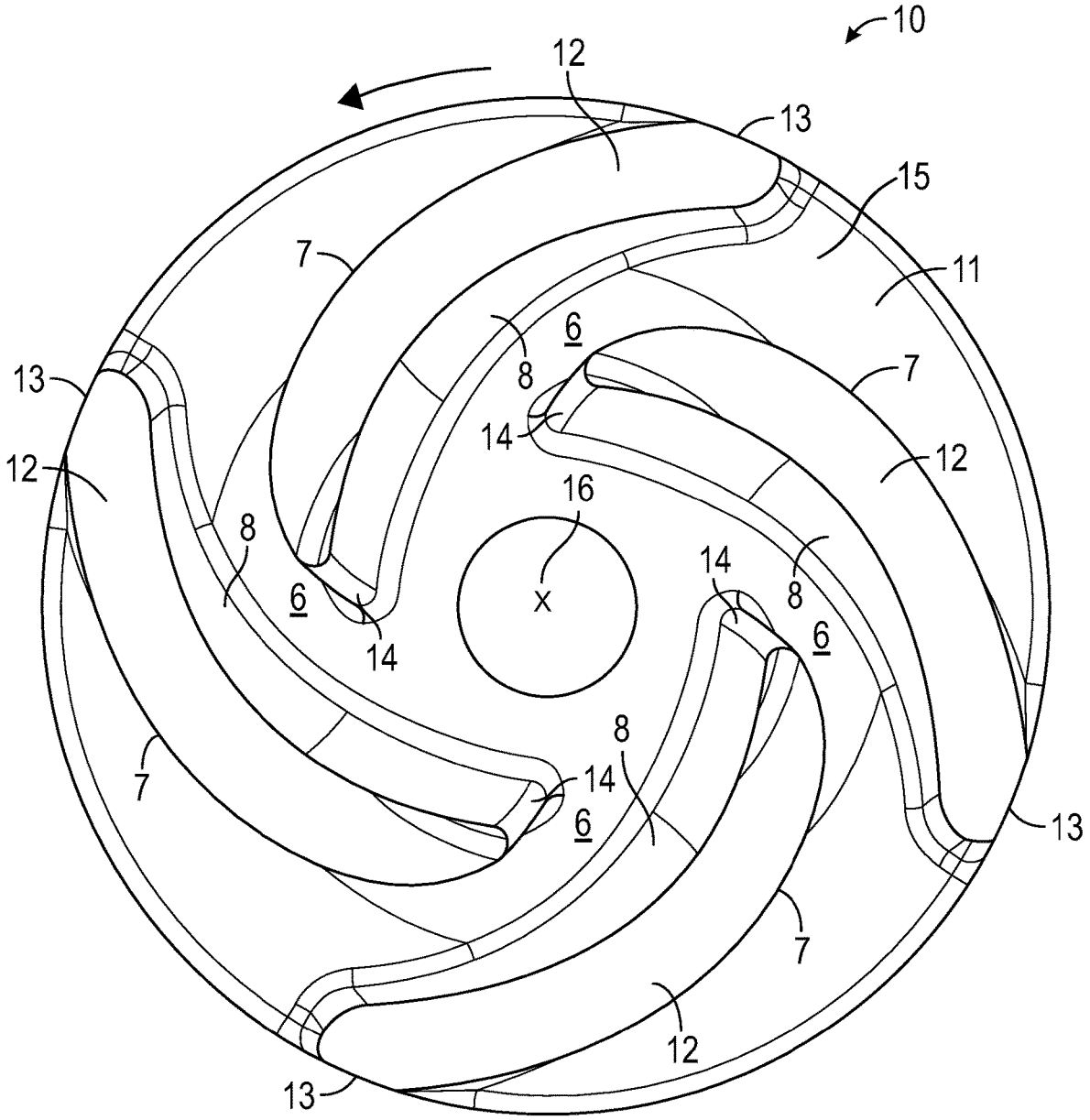
FIG. 1 is a front cross-section schematic view of a slurry pump impeller for a centrifugal slurry pump.

By means of the method described herein, it was found that a composite metal slurry pump impeller may be produced which finds application as a wear component for use in centrifugal slurry pumps in the minerals processing industry. In particular, it was found that when one or more cavities were formed during the casting process of the slurry pump impeller, the one or more cavities did not significantly affect the structural integrity of the slurry pump impeller and also allowed for a wear resistant composition in solid form to be bonded and/or secured into the one or more cavities to produce a composite metal slurry pump impeller with increased wear resistance properties.

In certain embodiments, a composite metal slurry pump impeller is provided which may be composed of a host metal composition including a wear resistant material bonded and/or secured within cavities formed during the casting process of the host metal composition. Alternatively, the cavities may be formed after the casting process by machining the cavities into the host metal composition.

The cavities are formed in the host metal composition and the resulting composite slurry pump impeller is composed of the host metal composition and the wear resistant material. The wear resistant material may be bonded or secured within cavities that may be located within the body of the slurry pump impeller composed of the host metal composition adjacent, or proximal to the passageways located between the pump vanes.

In certain embodiments, the wear resistant material is located such that it is encased within the main body of the composite metal slurry pump where the main working surfaces of the composite metal slurry pump are composed of the host metal composition. This allows that the working surfaces of the slurry pump are not hydrodynamically altered by the inclusion of the wear resistant material. In this embodiment, when the main body of the metal wear component begins to wear during use, the wear resistant material becomes exposed which then slows down the rate of wear experienced by the metal wear component.

In an alternative embodiment the wear resistant composition is included within cavities located on the main working surfaces of the composite metal slurry pump impeller, such as on the passageways between pumping vanes of the slurry pump impeller. In this form, the wear resistant material has a top surface that is recessed or flush (in line) with the surface of the inner face of the shroud of the pump impeller that is located in the passageways between the pumping vanes. Alternatively, the wear resistant material may sit proud of the surface of the inner face of the shroud to an extent where the impact of the wear resistant material does not materially affect the hydrodynamic properties of the shape of the slurry pump impeller.

The composite metal slurry pump impeller may be produced using methods of producing composite metal components such as for example described in WO 2019/119043 the contents of which is incorporated herein by reference.

The host metal composition may be selected from any suitable metal or metal alloy that is appropriate for casting wear components, such as for example high chromium white cast iron. The wear resistant composition would ideally have an increased wear resistance than the host metal composition and may be chosen from a material with a very high wear resistance such as tungsten carbide. The tungsten carbide may be sintered and/or may have a grain size of 2 to 6 micrometers. In a preferred form, the wear resistant composition is cylindrical, cuboid or button shaped or is of another form that is commonly manufactured. A commonly manufactured form such as cylindrical, cuboid or button shape has been found to be generally less expensive than other more irregular shapes which reduces the cost of producing the composite metal slurry pump impeller as herein described.

In an embodiment, the wear resistant composition is bonded into the one or more cavities in the host metal using an adhesive. The adhesive may have high gap filling capabilities and high tensile strength. For example, the adhesive may be selected from LOCTITE EA 9497 or 3M Scotch-weld 7236 B/A or other structural epoxy adhesive; or a high strength retaining compound such as Loctite 620, Loctite 638 or Loctite 660.

As an alternative, the wear resistant composition is bonded into the one or more cavities by using a brazing method. As a further alternative, or in addition to the above mentioned bonding examples, the wear resistant component may be bonded or secured into the one or more cavities via a mechanical locking arrangement such as for example a threaded plug, a shrink-fit plug or a close-fit plug secured by a high-strength retaining compound; these measures being employed to prevent the wear resistant component from coming out of the cavity in which it is secured during operation of the slurry pump impeller.

Referring to FIG. 1 there is shown a cross-section of a known centrifugal slurry pump impeller 10, the impeller 10 includes a back shroud 11 with four pumping vanes 12 extending from the shroud in a direction generally in line with an axis of rotation X of the slurry pump impeller when in use which provides that the pump impeller turns in a counter clockwise fashion as shown in FIG. 1. The inner face 15 of the back shroud in generally in a plane which is at right angles to the axis of rotation X. The four pumping vanes 12 each include a trailing edge 13 and a leading edge 14, where the leading edge 14 of the pumping vanes is adjacent the centre, or eye, 16 of the impeller 10 where the slurry enters during operation of an associated centrifugal slurry pump (not shown). The slurry passes via the eye and then is moved due to the orientation and rotation of the slurry pump impeller through the four passageways 6 located between adjacent pumping vanes 12. The pumping vanes 12 further include opposed main side faces 7, 8 which define the passageways 6 together with the inner surfaces 15, 17 of the back 11 and front shroud 21 (not shown in FIG. 1). The location and function of the four passageways 6 means that this section of the slurry pump impeller 10 and particularly the area of the passageways 6 along the inner surface 15 of the back shroud 17 are subjected to significant erosion and wear during the operation of a centrifugal slurry pump which means the inner surface 15 of the back shroud 17 is the location of a high degree of wear.

Figure 2:
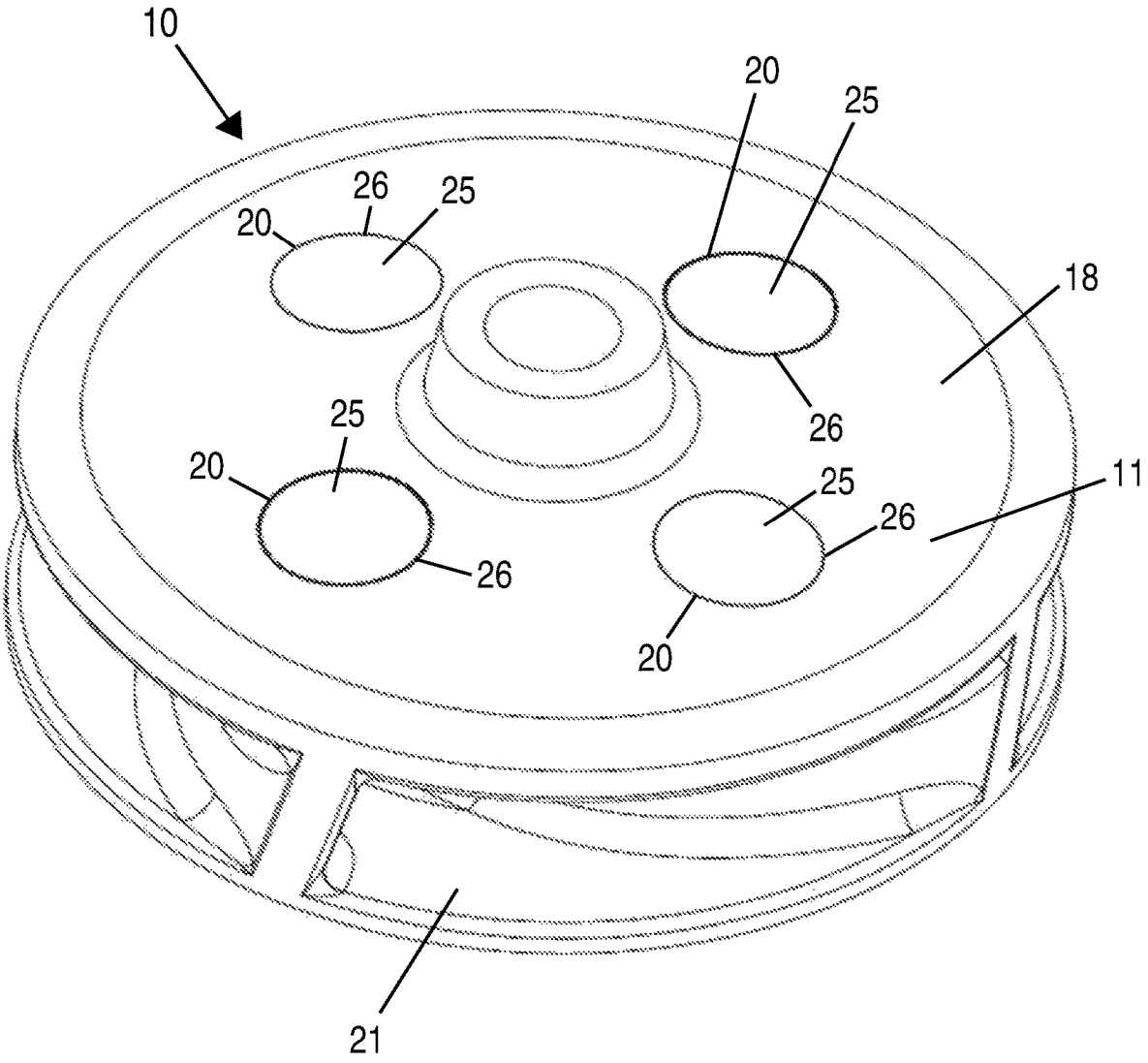
FIG. 2 is perspective view of a slurry pump impeller for a centrifugal slurry pump in accordance with an embodiment.
Figure 3:
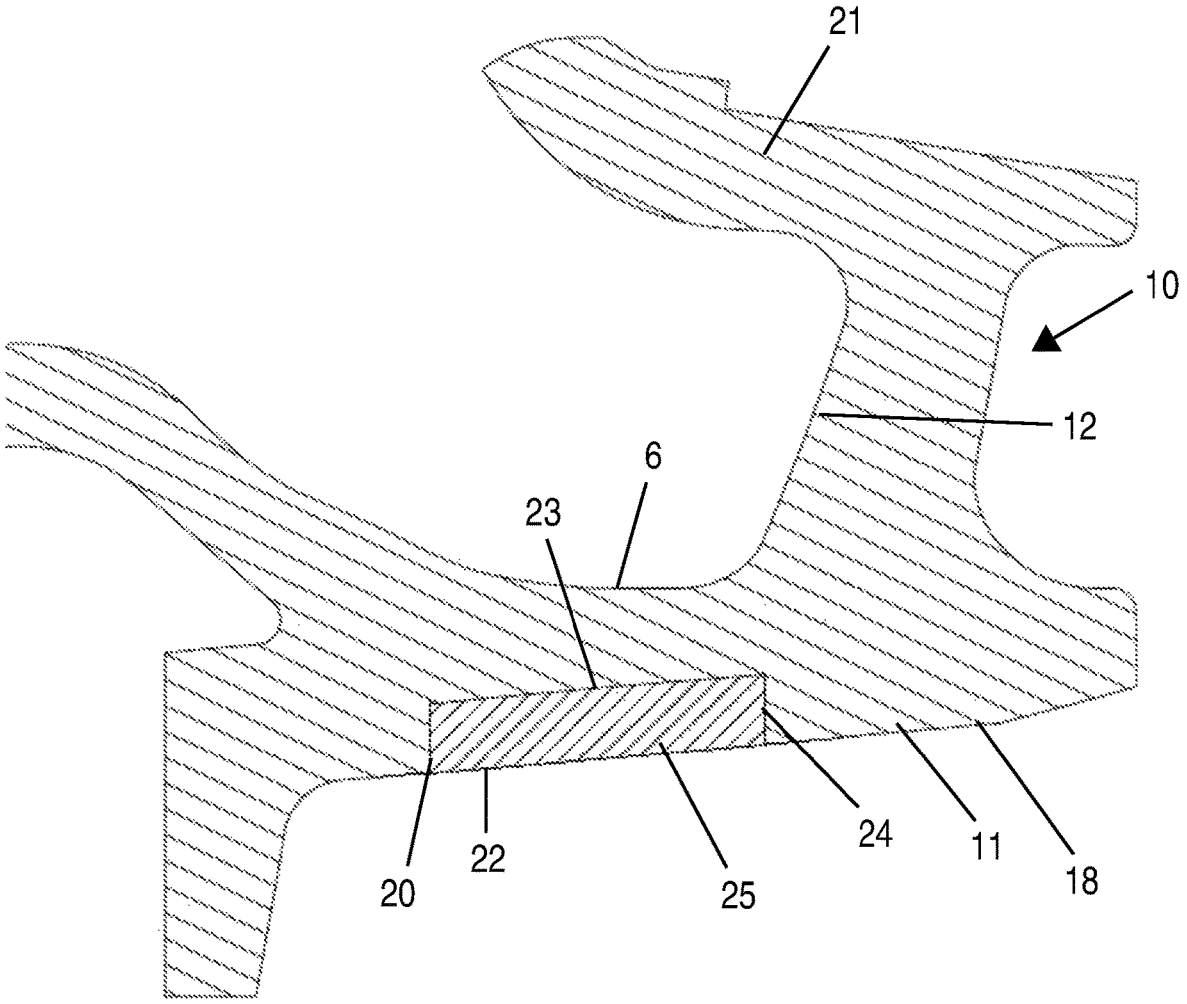
FIG. 3 is a cut away view of a passageway of a the slurry pump impeller for a centrifugal slurry pump depicted in FIG. 2.
Figure 4:
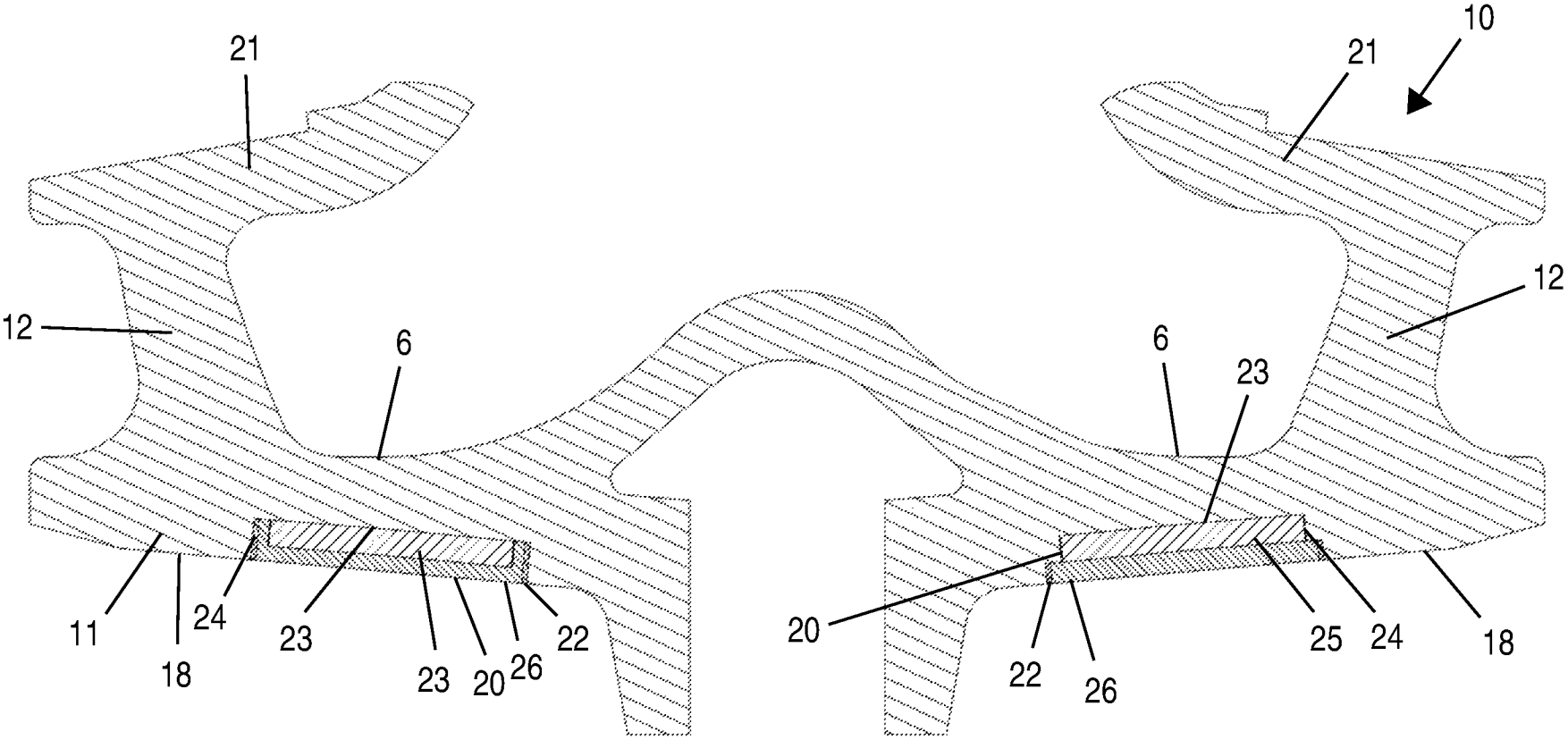
FIG. 4 is a cross-sectional view of a slurry pump impeller for a centrifugal slurry pump in accordance with another embodiment.

Referring to FIGS. 2 to 4 there are shown various views of a composite metal slurry pump impeller 10. FIG. 2 shows a perspective view from the rear side, or drive side of a slurry pump impeller, where the outer face 18 of the back shroud 11 is shown. The outer face 18 of the back shroud 11 includes four cavities 20 which are formed in the outer face of the back shroud 11 in the host metal composition forming the body of the composite metal slurry pump. The cavities are equally spaced around the outer face of the back shroud. Each of the cavities 20 include a wear resistant composition 25 which is bonded within each cavity 20.

Turning specifically to FIG. 3 and FIG. 4 it can be seen that the cavities 20 are located within the back shroud 11 in the region of the passageways 6 of the slurry pump impeller 10 which are defined as the space between two adjacent pumping vanes 12. The cavities include an end wall 23, side walls 24 as well as an opening 22. The wear resistant composition 25 is located within and then bonded within the cavities 20 when the slurry pump impeller is produced so as not to be exposed to the passageway 6. This means that when the slurry pump impeller is initially commissioned, the wear resistant composition does not affect the hydrodynamic properties of the slurry pump impeller 10 during operation.

The wear resistant composition 25 corresponds to the shape of the cavities 20 and may be cylindrical or disk like in shape where the diameter of the wear resistant composition 25 is significantly greater than its height. This provides that the diameter of the cavities 20 and the wear resistant composition 25 is at least 50%, and in preferred embodiments at least 75%, of the cross section of the passageways 6 located between respective pumping vanes 12. As the location of the cavities 20 and the wear resistant composition 25 is in the region of the passageways 6, once the inner surface of the back shroud 11 which forms the passageways 6 begins to wear during use of the slurry pump impeller 10 the wear gradually exposes the surface of the wear resistant material 25 bonded with the cavities 20. The wear resistant composition 25 once exposed then slows the rate of wear in the region of the passageways 6 resulting in extended service life of the composite metal slurry pump impeller 10. The wear resistant composition may be located about from 5 mm to 25 mm below the surface on the inner face of the back shroud 11 when initially manufactured.

As shown in FIG. 4, a plug portion 26 in the form of a disk may also be located on top of the wear resistant composition 25 and held in place via an adhesive, piston ring or multi start thread. The plug portion 26 is composed of a material such as high chrome cast iron which is reasonably wear resistant as it will be exposed to the abrasive conditions on the outer face of the back shroud when the slurry pump impeller 10 is in use. The shape of the cavity 20 may include a narrow diameter portion for receiving the wear resistant composition 20 which is followed by a wider diameter portion for receiving the plug portion 26. This arrangement is shown in the embodiment appearing on the right hand side of FIG. 4. An alternative arrangement is shown on the left side of FIG. 4 where the cavity 20 has a uniform diameter and the plug portion 26 is larger in diameter than the wear resistant composition and includes side portions adjacent the side walls 24 of the cavity which encapsulate, or cover, the side walls of the wear resistant composition 23.

Figure 5:
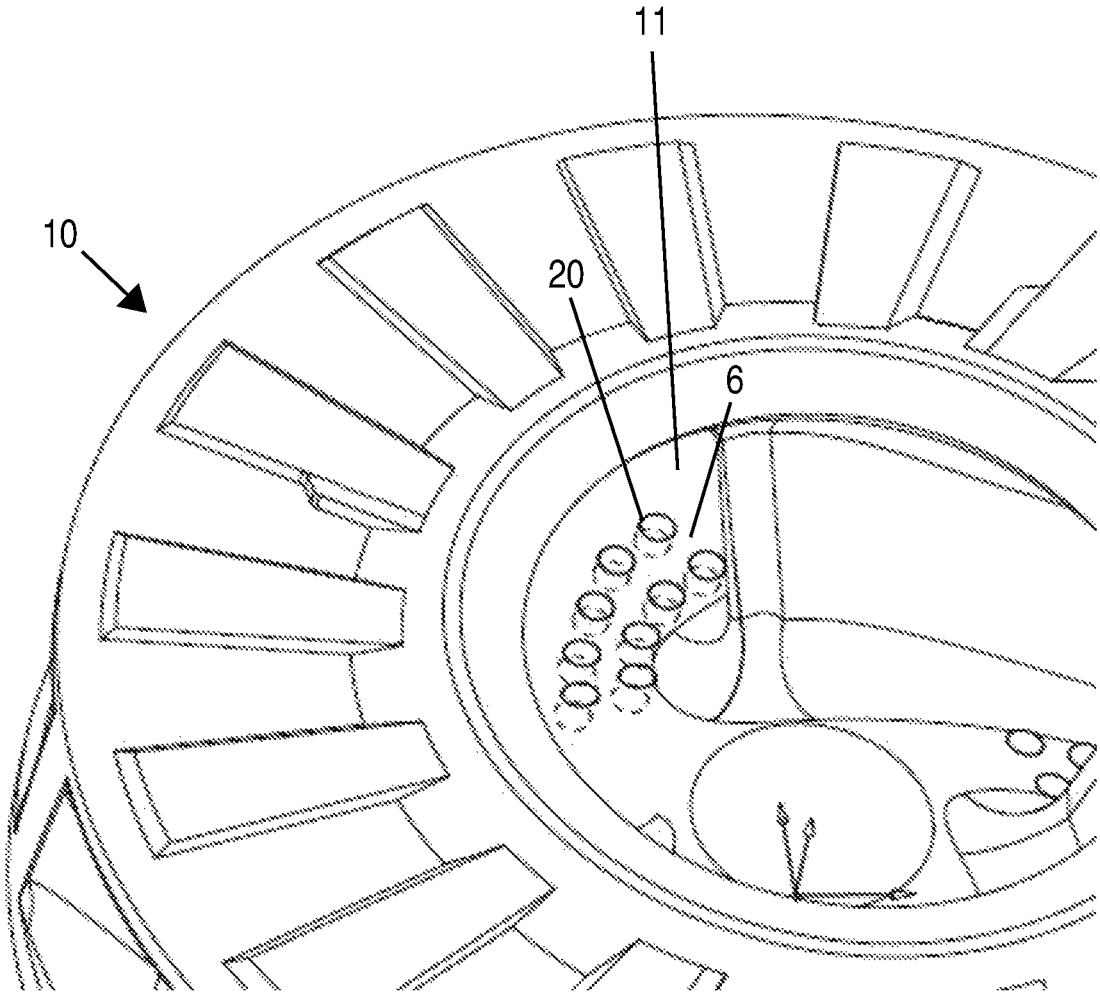
FIG. 5 is a part perspective view looking into the inlet of a slurry pump impeller for a centrifugal slurry pump in accordance with another embodiment.
Figure 6:
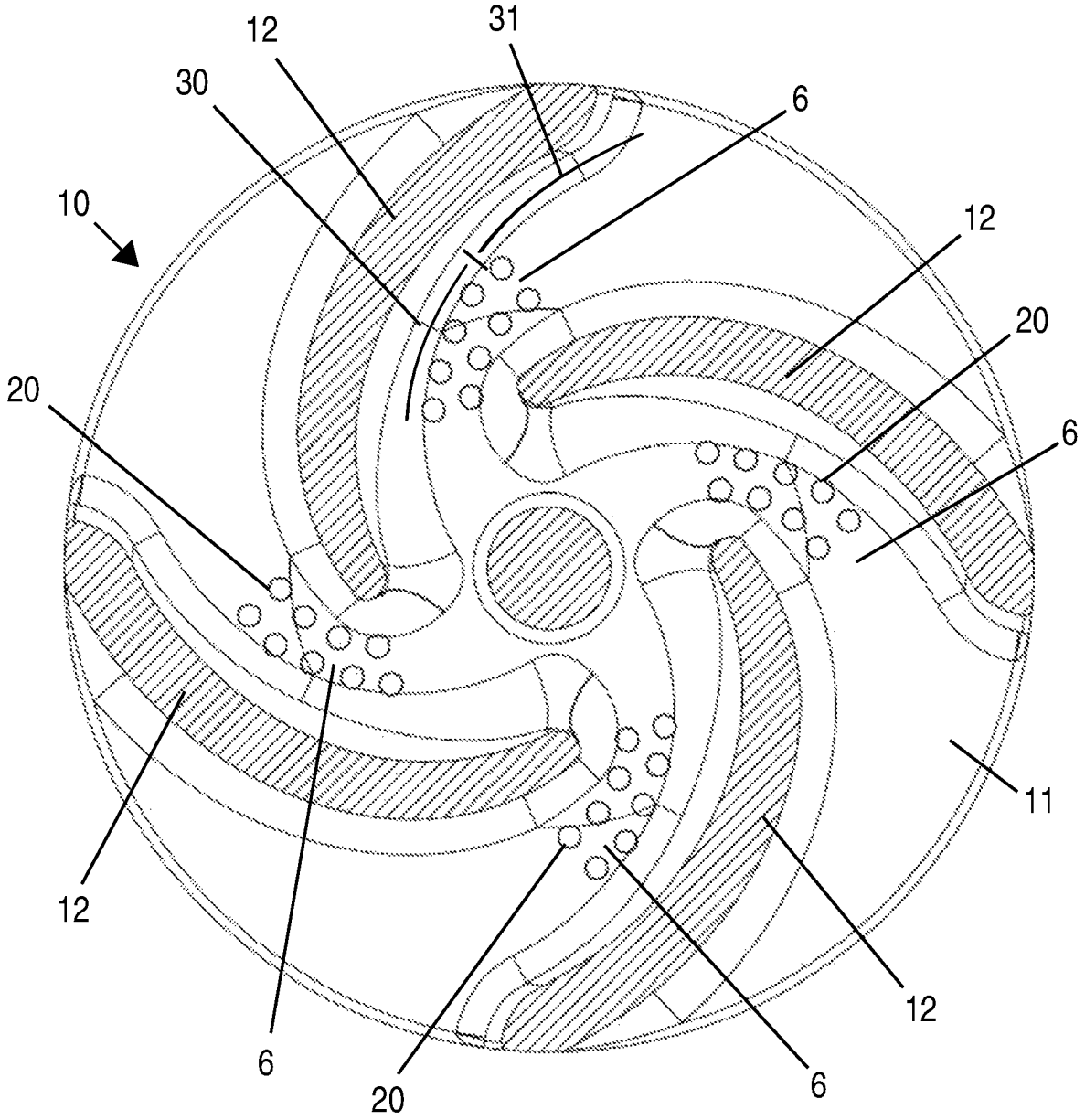
FIG. 6 is a front cross-section schematic view of a slurry pump impeller for a centrifugal slurry pump in accordance with another embodiment.
Figure 7:
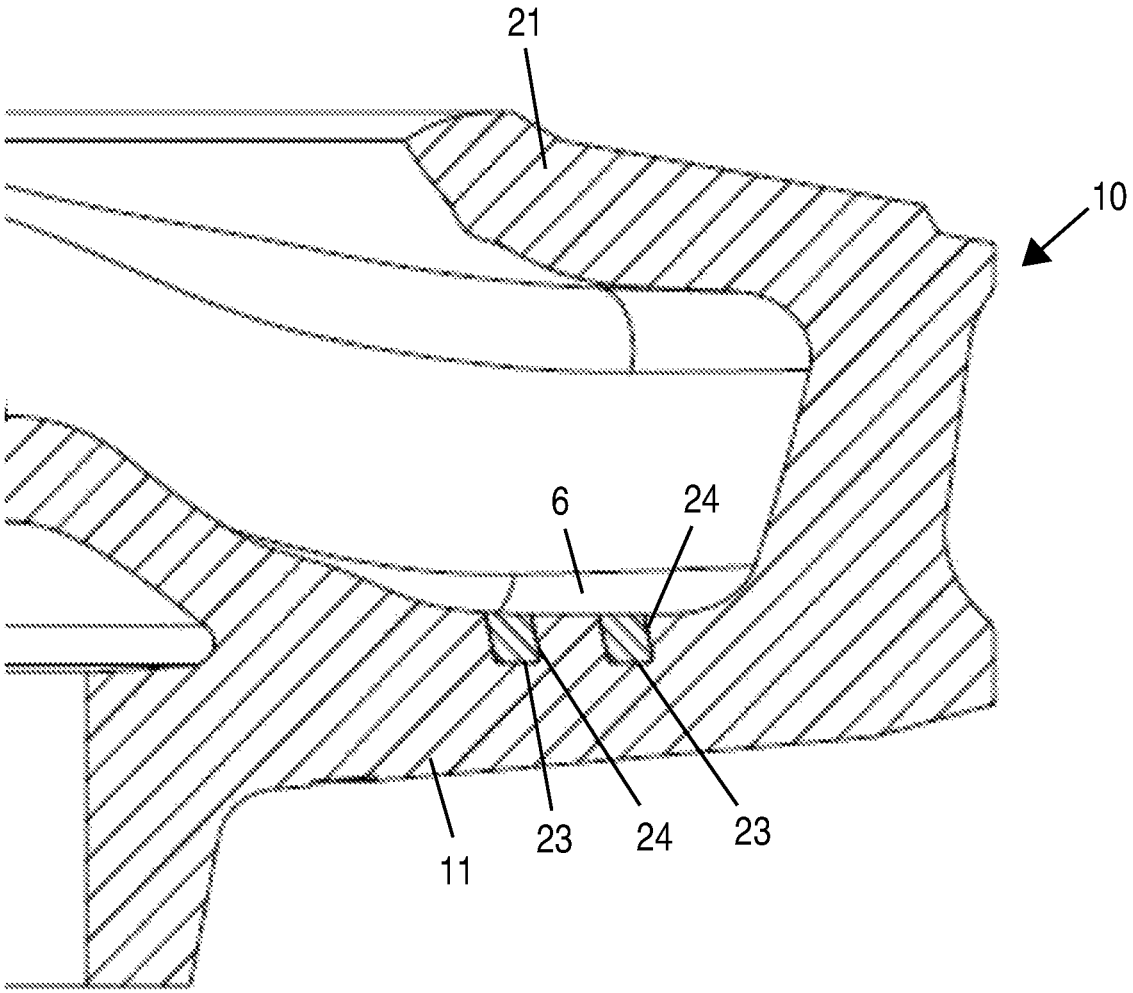
FIG. 7 is a cut away view of a passageway of the slurry pump impeller for a centrifugal slurry pump depicted in FIG. 6.

Another embodiment of a composite metal slurry pump impeller 10 in accordance with the disclosure is shown in FIG. 5, FIG. 6 and FIG. 7. Referring specifically to FIG. 6 there is shown a cut away perspective view of the impeller 10 with the front shroud removed looking onto the pumping vanes 12 and passageways 6 located on the inner surface of the back shroud 11 between the pumping vanes 12. A number of cavities 20 are shown in each of the passageways 6 of the impeller 10 which include an opening 20, side walls 24 and an end wall 23. Whilst not shown in FIGS. 5 and 6, a wear resistant composition in the form of a cylindrical insert may be bonded within the cavities using methods described previously. The cavities 20 extend through the thickness of the back shroud 11 until there is about 5 mm to about 75 mm between the bottom of the cavities 20 to the outer surface of the back shroud 11. Otherwise, stated the cavities may extend about a third to about four fifths through the thickness of the back shroud 11.

Referring to FIG. 7 it can be seen that the shape and direction of the cavities 20 may be inclined from the plane of the back shroud wherein the wear resistant composition 25 bonded within the cavities 20 is angled towards or against the direction of the flow of slurry when the slurry pump impeller 10 is in use. Otherwise stated, a line normal to a central axis of the cavities 20 is at an angle to the surface of the inner face of the back shroud 11 when facing the direction of flow passing from the leading edge through the passageways of the impeller. The angle may be from about 50° to about 85° or from about 70° to about 80°.

In FIG. 6 it can be seen that the cavities are grouped in rows when located in the passageways and are located in an inner region 30 of the passageways 6 and are not located in an outer region 31 of the passageways. It was found that by locating the cavities 20 and the wear resistant composition 25 in the inner region 30 of the passageways 6, this provided a significant reduction in wear in that region of the back shroud. The addition of the cavities and the wear resistant composition in the outer region 31 of the passageways 6 did not result in a significantly improved wear resistance which warrants the increased cost of production involved.

Once placed within the cavities 20, a top surface of the wear resistant composition 25 may be recessed, set flush, substantially flush or just proud of the inner surface of the back shroud 11. During use, the wear resistant composition significantly slows the rate of wear in the inner region of the passageways which enhances the working life of the composite metal slurry pump impeller 10.

Figure 8:
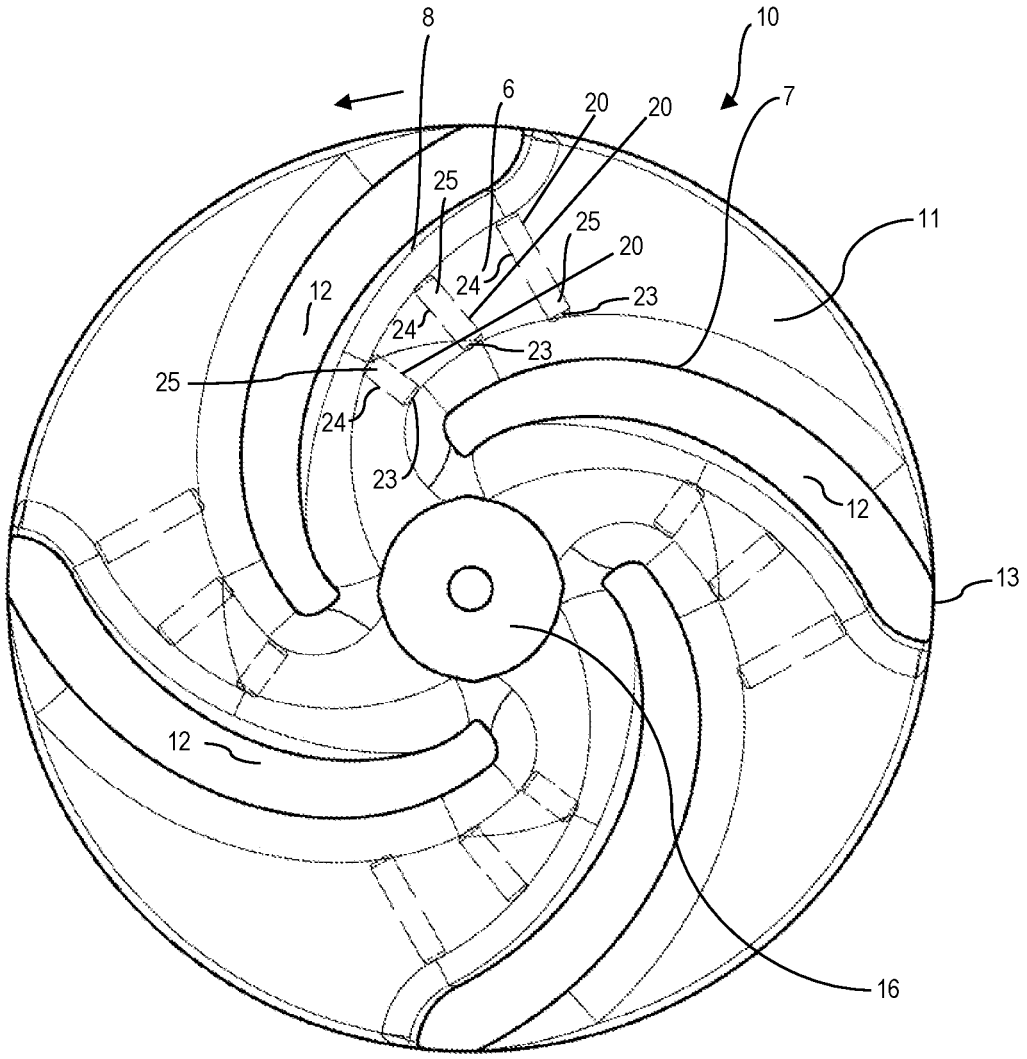
FIG. 8 is a front cross sectional view of a centrifugal slurry pump impeller in accordance with an embodiment, which depicts the location of cavities located below the inner surface of the back shroud.
Figure 9:
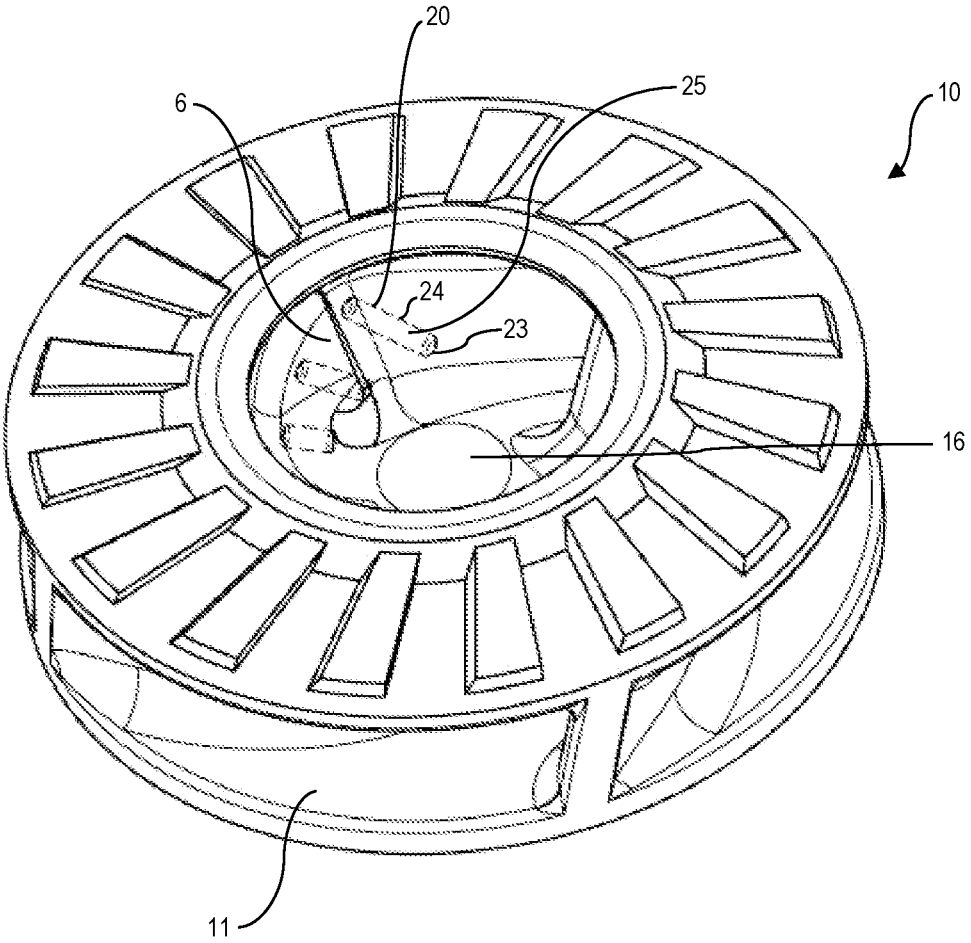
FIG. 9 is a perspective view of the centrifugal slurry pump impeller of FIG. 8 looking into the inlet opening and the entry to the passageways.
Figure 10:
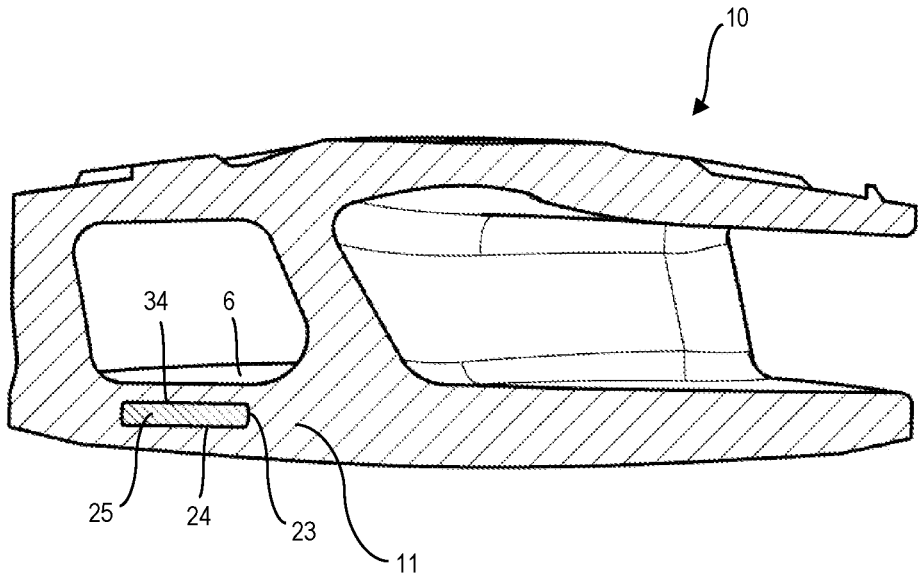
FIG. 10 is a cut away view of the centrifugal slurry pump impeller of FIG. 8 and FIG. 9, showing the location of the cavities within the back shroud beneath the surface of the passageways.

Another embodiment of a composite metal slurry pump impeller 10 in accordance with the disclosure is shown in FIG. 8, FIG. 9 and FIG. 10. Referring to FIG. 8 there is shown a cut away view of an impeller 10 with the front shroud removed looking onto the pumping vanes 12 and passageways 6 located on the inner surface of the back shroud 11 between the pumping vanes 12. Each passageway 6 includes the outline of three cavities 20 which are located below the surface of the passageways 6 on the inner face of the back shroud 11.

The cavities 20 located in the impeller depicted in FIGS. 8, 9 and 10 are cylindrical in shape and include a circular end wall 24 and cylindrical side walls including a contact portion 34 best shown in FIG. 10. The contact portion 34 is part of the side walls which is most remote from the outer face of the back shroud 11 and is the portion of the side walls 24 which is closest to the inner surface of the back shroud 11 which forms the passageways 6 between the pumping vanes 12 of the impeller 10. The contact portion 34 may be spaced from the surface of the inner main face of the back shroud 11. In a preferred form, the contact portion 34 of the side walls may be located within about 5 mm to about 25 mm from the surface of the inner main face of the back shroud.

The length of the side walls 24 and the contact portion 34 of the cavities 20 may span a substantial distance from one opposed side face 7 to the other opposed side face of the pumping vanes 12. In a preferred form, the contact portion 34 of the cavities 24 may be located across a majority, and preferably all of the width of the passageway from one opposed side face 7 to the other opposed side face 8 of the pumping vanes 12.

As shown in FIGS. 8 and 9 the length of the side walls 24 and the contact portion 34 of each of the cavities 20 may be orientated perpendicular to the direction of the flow passing through the passageways when the impeller 10 is in use. The length of the side walls 24 and the contact portion 34 may also be located in a plane that is perpendicular to the axis of rotation when the pump impeller in use.

The wear resistant composition 25 is located within and then bonded within the cavities 20 when the slurry pump impeller is produced so as not to be exposed to the passageway 6. This provides that when the slurry pump impeller is initially commissioned, the wear resistant composition does not affect the hydrodynamic properties of the slurry pump impeller 10 during operation.

The wear resistant composition 25 corresponds to the shape of the cavities 20 and may be cylindrical in shape where the height of the wear resistant composition 25 is significantly greater than its width. This provides that the length of the side wall and the contact portion of the cavities 20 and the wear resistant composition 25 is at least 50%, and in preferred embodiments at least 75%, of the cross section of the passageways 6 located between respective pumping vanes 12. As the location of the cavities 20 and the wear resistant composition 25 is in the region of the passageways 6, once the inner surface of the back shroud 11 which forms the passageways 6 begins to wear during use of the slurry pump impeller 10 this gradually exposes the surface of the wear resistant material 25 bonded within the cavities 20 at the location of the contact portion 34. The wear resistant composition 25 once exposed then slows the rate of wear in the region of the passageways 6 immediately downstream (towards the peripheral edge of the back shroud) from the wear resistant composition 25 resulting in extended service life of the composite metal slurry pump impeller 10. The wear resistant composition 25 may be located about from 5 mm to 25 mm below the surface on the inner face of the back shroud 11 when the impeller 10 is initially manufactured.

As shown in FIGS. 8 and 9, each passageway 6 may include at least two cavities 20 in the embodiment depicted, each of the passageways 6 include three cavities 20. The cavities 20 may be spaced along the length of the passageways 6 and in a preferred form are located in the first two thirds of the length of each passageway starting from the leading edge of the pumping vanes 12.

Figure 11:
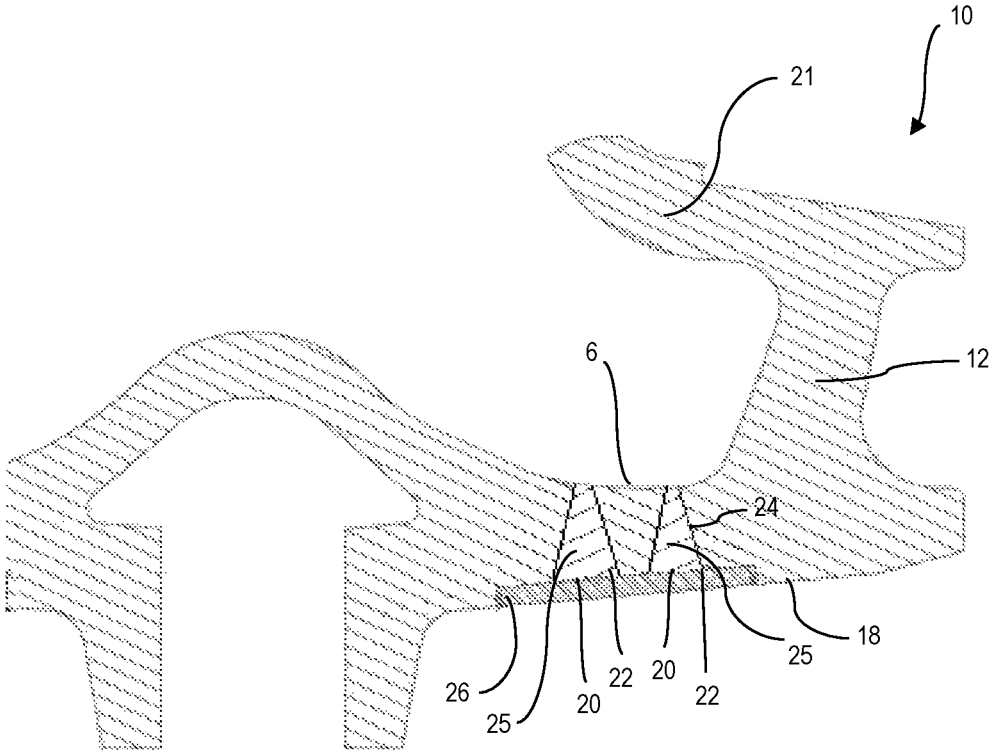
FIG. 11 is a cut away view of a passageway of the slurry pump impeller for a centrifugal slurry pump in accordance with another embodiment.
Figure 12:
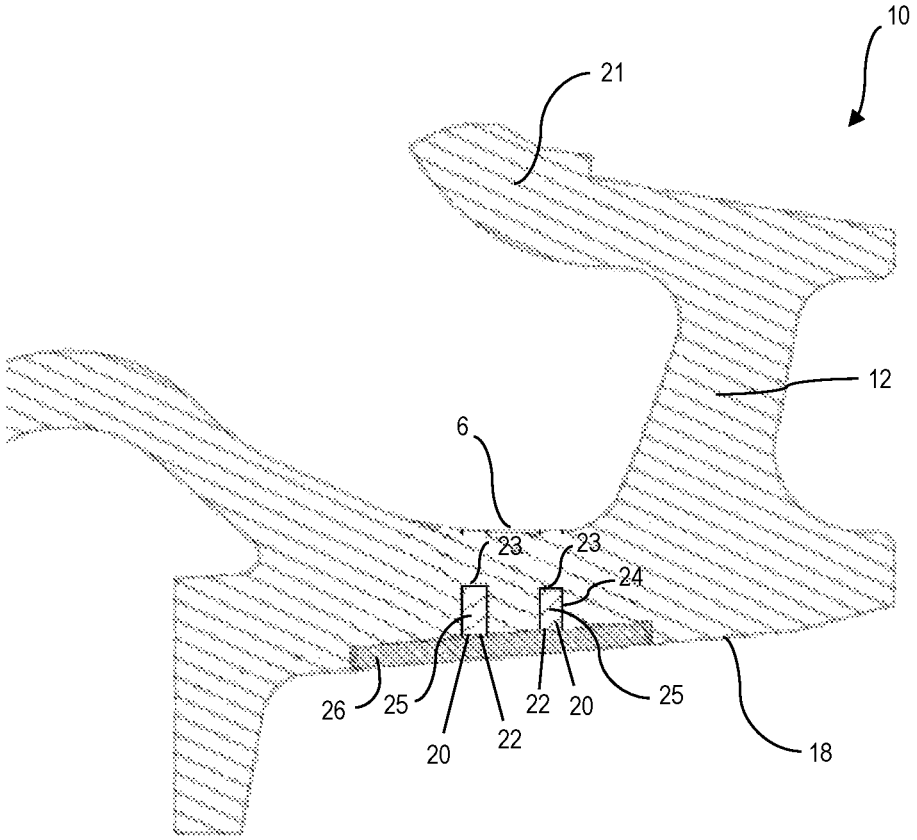
FIG. 12 is a cut away view of a passageway of the slurry pump impeller for a centrifugal slurry pump in accordance with another embodiment; and, FIG. 13 is a cut away view of a passageway of the slurry pump impeller for a centrifugal slurry pump in accordance with another embodiment.
Figure 13:
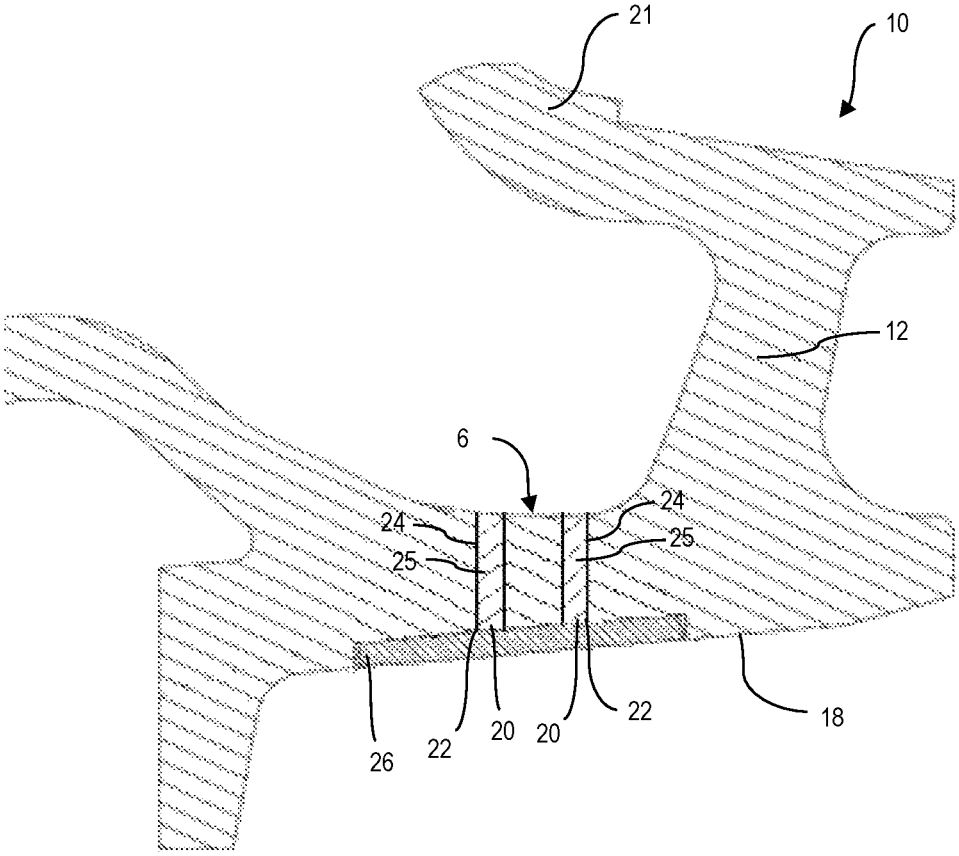

Referring to FIGS. 11, 12 and 13 there are shown three further embodiments respectively of a composite metal slurry pump impeller 10. In each embodiment, the impeller 10 includes cavities 20 which are formed in the outer face of the back shroud 11 in the host metal composition forming the body of the composite metal slurry pump impeller 10. Each of the cavities 20 include a wear resistant composition 25 which is bonded within each cavity 20. The cavities 20 are located within the back shroud 11 in the region of the passageways 6 of the slurry pump impeller 10 which are defined as the space between two adjacent pumping vanes 12.

The cavities shown in each of FIGS. 11, 12 and 13 include side walls 24 and an opening 22. However, only the embodiment shown in FIG. 12 includes an end wall 23 to the cavities 20 wherein the wear resistant composition 25 is located within and then bonded within the cavities 20 when the slurry pump impeller is produced so as not to be exposed to the passageway 6.

The cavities 20 depicted in FIG. 11 and FIG. 13 are in an alternative configuration where the cavities pass right through the body of the back shroud 11 to the surface of the passageway 6. This provides that the wear resistant composition 25 is bonded within the cavities 20 so that the wear resistant composition is flush or just proud of the surface of the passageways 6 on the inner main face of the back shroud 11.

The wear resistant composition 25 corresponds to the shape of the cavities 20 and may be cylindrical in shape as shown in FIGS. 12 and 13, or frustoconical in shape as shown in FIG. 11. The frustoconical shape of the wear composition 25 corresponds to the shape of the side walls 24 of the cavities 20 depicted in FIG. 11. The frustoconical shape of the cavities and the corresponding frustoconical shape of the wear composition 25 bonded within the cavities 20 provides increased resistance to movement between the host metal and the wear composition as the host metal composition begins to wear during use of the impeller 10. An alternative form of the embodiment shown in FIG. 11 may also be provided where an end wall is provided in the frustoconical shaped cavities whereby the wear resistant composition is located below the surface of the passageways on the inner face of the back shroud when the impeller 10 is initially manufactured.

As the location of the cavities 20 and the wear resistant composition 25 is in the region of the passageways 6, once the inner surface of the back shroud 11 which forms the passageways 6 begins to wear during use of the slurry pump impeller 10 the wear gradually exposes the surface of the wear resistant material 25 bonded with the cavities 20. The wear resistant composition 25 once exposed then slows the rate of wear in the region of the passageways 6 resulting in extended service life of the composite metal slurry pump impeller 10.

A plug portion 26 in the form of a disk may also be located on top of the wear resistant composition 25 depicted in FIGS. 11, 12 and 13 within the cavities 20 and held in place via an adhesive, piston ring or multi start thread. The plug portion 26 may be large enough to cover the openings 22 of more than one cavity and preferably at least two to six cavities 20. The plug portion 26 may be composed of a material such as high chrome cast iron which is reasonably wear resistant as it will be exposed to the abrasive conditions on the outer face of the back shroud when the slurry pump impeller 10 is in use.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

| List of Parts | |
|---|---|
| passageways | 6 |
| opposed side faces | 7, 8 |
| top surface | 9 |
| impeller | 10 |
| back shroud | 11 |
| pumping vane | 12 |
| trailing edge | 13 |
| leading edge | 14 |
| Inner face of back shroud | 15 |
| impeller eye | 16 |
| Inner face of front shroud | 17 |
| Outer face of back shroud | 18 |
| cavity | 20 |
| front shroud | 21 |
| opening | 22 |
| end wall | 23 |
| side wall | 24 |
| wear resistant composition | 25 |
| plug portion | 26 |
| inner region | 30 |
| outer region | 31 |
| front shroud | 21 |
| opening | 22 |
| contact portion | 34 |

The invention claimed is:

1. A composite metal centrifugal slurry pump impeller including a back shroud with an opposed inner face and outer face with an outer peripheral edge and a central axis, a plurality of pumping vanes extending away from the inner face of the back shroud, the pumping vanes being disposed in spaced apart relation, each pumping vane including opposed main side faces, a leading edge in a region of the central axis and a trailing edge in a region of the outer peripheral edge of the back shroud with a passageway between adjacent pumping vanes, wherein one or more cavities are located in the back shroud in a region of at least one passageway formed between adjacent pumping vanes and wherein a wear resistant composition is bonded at least partially within the one or more cavities, wherein the one or more cavities are formed in the outer face of the back shroud whereby the wear resistant composition is not exposed to the passageway.

2. The centrifugal slurry pump impeller according to claim 1, wherein the one or more cavities include side walls and an end wall wherein the end wall is spaced from a surface of the inner face of the back shroud.

3. The centrifugal slurry pump impeller according to claim 1, wherein the one or more cavities includes a circular opening, cylindrical shaped side walls and a circular shaped end wall.

4. The centrifugal slurry pump impeller according to claim 3, wherein the end wall of the one or more cavities has a diameter spanning a distance that substantially covers the width of the passageway between adjacent pumping vanes.

5. The centrifugal slurry pump impeller according to claim 1 wherein the wear resistant composition substantially fills the one or more cavities.

6. The centrifugal slurry pump impeller according to claim 1, wherein the wear resistant composition is cylindrical in shape.

7. The centrifugal slurry pump impeller according to claim 1, wherein the wear resistant composition has a diameter which is greater than its height.

8. The centrifugal slurry pump impeller according to claim 1, wherein a plug portion is located in the one or more cavities for covering the wear resistant composition located within the one or more cavities.

9. The centrifugal slurry pump impeller according to claim 8, wherein the plug portion includes an outer surface which is substantially flush with, or in the same plane as, a surface of the outer face of the back shroud.

10. A composite metal centrifugal slurry pump impeller including a back shroud with an opposed inner face and outer face with an outer peripheral edge and a central axis, a plurality of pumping vanes extending away from the inner main face of the back shroud, the pumping vanes being disposed in spaced apart relation, each pumping vane including opposed main side faces, a leading edge in a region of the central axis and a trailing edge in a region of the outer peripheral edge of the back shroud with a passageway between adjacent pumping vanes of the plurality of pumping vanes, wherein one or more cavities are located in the back shroud in a region of at least one passageway and wherein a wear resistant composition is bonded at least partially within the one or more cavities, wherein the one or more cavities include side walls and an end wall, wherein the side walls include a contact portion remote from the outer face of the back shroud and wherein the contact portion is spaced from a surface of the inner face of the back shroud.

11. The centrifugal slurry pump according to claim 10, wherein the one or more cavities each include cylindrical side walls having a length and a circular shaped end wall, and wherein in use, the length of the side walls of each cavity of the one or more cavities and a contact portion of the side walls are orientated perpendicular to the direction of the flow passing through the passageway and in a plane that is perpendicular to the axis of rotation of the pump impeller in use.

12. The centrifugal slurry pump according to claim 10, wherein the length of the side walls and the contact portion extend substantially across the passageway between one pumping vane to an adjacent other pumping vane of the plurality of pumping vanes.

13. The centrifugal slurry pump impeller according to claim 10, wherein the wear resistant composition substantially fills the one or more cavities.

14. The centrifugal slurry pump impeller according to claim 10, wherein each passageway includes three cavities located in spaced relation along the inner two thirds of the length of each passageway.

15. A composite metal centrifugal slurry pump impeller including a back shroud with an opposed inner face and outer face with an outer peripheral edge and a central axis, a plurality of pumping vanes extending away from the inner main face of the back shroud, the pumping vanes being disposed in spaced apart relation, each pumping vane of the plurality of pumping vanes including opposed main side faces, a leading edge in a region of the central axis and a trailing edge in a region of the outer peripheral edge of the back shroud with a passageway between adjacent pumping vanes of the plurality of pumping vanes, wherein one or more cavities are formed in the inner face of the back shroud in a region of at least one passageway and wherein a wear resistant composition is bonded at least partially within the one or more cavities, wherein the one or more cavities each include a circular opening, cylindrical shaped side walls and a circular shaped end wall and wherein a line normal to a central axis of the one or more cavities is at an angle to a surface of the inner face of the back shroud.

16. The centrifugal slurry pump impeller according to claim 15, wherein the one or more cavities are inclined from a plane of the back shroud wherein the wear resistant composition bonded within the one or more cavities is angled against the direction of the flow of slurry when the slurry pump impeller is in use.

17. The centrifugal slurry pump impeller according to claim 15, wherein each passageway includes an inner region which begins adjacent the leading edge of the plurality of pumping vanes and ends mid-way along each passageway, and an outer region which begins mid-way along each passageway and ends adjacent the outer peripheral edge, wherein the one or more cavities are substantially located in the inner region of each passageway.

18. The centrifugal slurry pump impeller according to claim 15, wherein the wear resistant composition sits proud of the surface of the inner face of the back shroud.

19. The centrifugal slurry pump impeller according to claim 15, wherein the slurry pump impeller is composed of a high chromium white cast iron, and the wear resistant composition is selected from tungsten carbide.

20. The centrifugal slurry pump impeller according to claim 1, wherein the one or more cavities are formed in the outer face of the back shroud.

21. The centrifugal slurry pump impeller according to claim 20, wherein the one or more cavities pass from the outer face of the back shroud towards the inner face of the back shroud in the region of the passageways.

22. The centrifugal slurry pump impeller according to claim 20, including a plug portion at the opening of the one or more cavities, wherein the plug portion covers the wear resistant composition located within the one or more cavities.

23. The centrifugal slurry pump impeller according to claim 20, wherein the plug portion includes an outer surface which is substantially flush, or in the same plane as a surface of the outer face of the back shroud.

* * * * *